US005286030A

United States Patent [19]

Villagomez

[11] Patent Number: 5,286,030

[45] Date of Patent: Feb. 15, 1994

[54] BOARD GAME APPARATUS

[76] Inventor: Butler A. Villagomez, 3111 Janet Rd., Wheaton, Md. 20906

[21] Appl. No.: 991,133

[22] Filed: Dec. 29, 1992

[51] Int. Cl.[5] ..... A63F 3/00

[52] U.S. Cl. ..... 273/242

[58] Field of Search ..... 273/242, 260, 261, 275, 273/284

[56] References Cited

U.S. PATENT DOCUMENTS

| | | | |
|---|---|---|---|
| 2,199,719 | 5/1940 | Brothers | 273/242 X |
| 3,887,190 | 6/1975 | Ameri | 273/242 X |
| 4,339,136 | 7/1982 | Gittings | 273/242 |
| 4,515,370 | 5/1985 | Garcia | 273/261 X |
| 4,659,086 | 4/1987 | Colborne | 273/242 |
| 5,014,995 | 5/1991 | Woodward | 273/261 |
| 5,026,068 | 6/1991 | Weisser | 273/242 X |

FOREIGN PATENT DOCUMENTS

| | | | |
|---|---|---|---|
| 1238571 | 7/1960 | France | 273/242 |
| 1413298 | 8/1965 | France | 273/242 |
| 1417861 | 10/1965 | France | 273/242 |

*Primary Examiner*—William Stoll
*Attorney, Agent, or Firm*—Longacre & White

[57] ABSTRACT

A board game apparatus including two playing boards, each having a different playing surface with a plurality of triangular playing spaces upon which are positioned and moved two sets of playing pieces, one for each player. Each set of playing pieces includes a number of pieces which are separately movable to different groups of the triangular playing spaces. The players alternately move one piece each with the objective being to threaten the opposing player's most important piece with imminent capture.

16 Claims, 24 Drawing Sheets

BOARD GAME APPARATUS

BACKGROUND OF THE INVENTION

The invention concerns a board game for two opponent players, consisting of 54 equilateral triangular spaces of two alternating colors inside of an inner rectangle where play takes place, two sets of 18 three-dimensional pieces each set and two sets of 18 circular game chips each set, rules of movement and capture and the object of the game.

SUMMARY OF THE INVENTION

The objectives of this invention are to provide a board game with the following characteristics:

a) for two players, simpler than other well-known games;

b) in which some of the most important aspects of the board game fulfill certain proportions among them: X to Y=proportion, where Y=1 is always the lower number of the proportion;

c) in which the number of triangular spaces of the board (e.g. 54) be in a proportion of 1.5 to 1 to the number of game pieces (e.g. 36);

d) in which the number of basic movements (e.g. 4) be in a proportion of 2 to 1 to the number of different colors of the spaces of the board (e.g. 2);

e) in which the number of game pieces (e.g. 36) be in a proportion of 2 to 1 to the maximum number of straight directions of movement on the board (e.g. 18);

f) with simple game rules;

g) with multiple openings and defense options;

h) having the option of great complexity as the game develops;

i) taking little space;

j) being useful in other ways in addition to this one;

k) with less probability of draws.

This is a board game in which opponents move and capture pieces in play. In one preferred embodiment, the board consists of 54 equilateral triangular spaces, enclosed in inner and outer rectangles serving as a frame and partially limiting the spaces in play. The spaces are of two alternating types, forming horizontal and inclined rows, vertical and inclined columns of one and two colors. There are two ways of arranging the triangular spaces inside of the same inner rectangle.

One arrangement has a hexagon at the center of the board, made up of six triangles (FIG. 1). The other arrangement has a rhombus at the center of the board, made up of two triangles (FIG. 2).

The game pieces are of two kinds.

a) Two sets of 18 three-dimensional pieces, light and dark, (FIG. 3).

b) Two sets of 18 circular chips, light and dark, with geometrical representations of the three-dimensional game pieces on one side (FIG. 4).

Both sets of game pieces and game chips can be used on either of the two boards. Both sets of game pieces and game chips may have magnetic bases.

The light colored game pieces are placed on the first and second horizontal rows of two colors of one of the boards. The dark game pieces are placed on the fifth and sixth horizontal rows of one of the boards. The 9 light colored sems are placed on the second horizontal row of one of the boards; the 9 dark sems are placed on the fifth horizontal row of one of the boards. The 9 major dark game pieces are placed on the sixth horizontal row of one of the boards, according to the fixed pattern in the upper margin of the board. The 9 major light colored game pieces are placed on the first horizontal row of one of the boards, according to the fixed pattern in the upper margin of the board.

There are rules of general movement for all the pieces, and rules of particular movement for some pieces.

To start the game, the player playing the light colored pieces moves one piece once; then the player playing the dark pieces moves one piece once, and so on. The object of the game is to threaten the opponent's ova with immediate inevitable capture.

For the purpose of this application, the orientation of the game board is as follows:

a) Horizontal orientation. The correct way to view the board is with the letters a-b-c-d-e-f-g-h-i at the bottom. The first row of triangles above the letters shall be considered row # 1, the row above that, row # 2, and so on, up to row #6.

b) Vertical orientation. There are no real columns, per se, on this board. Nevertheless, it will be useful to define some form of vertical orientation as well. To this end, the series of triangles sitting directly atop letter "a" shall be considered column "a", the triangles atop letter "b", column "b", and so on, up to column "i".

BRIEF DESCRIPTION OF THE DRAWING

FIG. 1 is the first playing surface and FIG. 2 is the second playing surface.

DESCRIPTION OF THE PREFERRED EMBODIMENT

Figure 1:
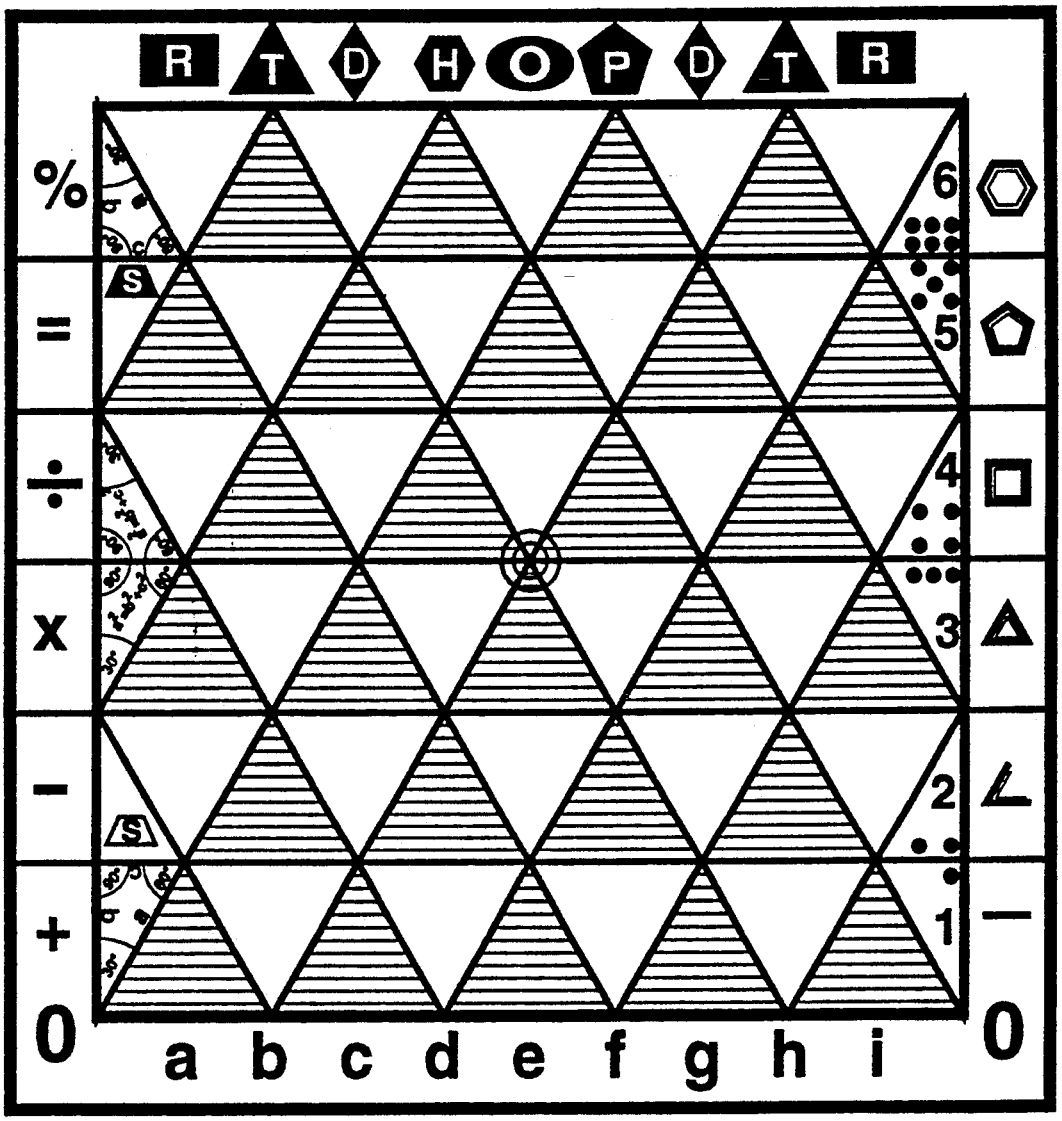
FIGS. 1 and 2 are views of the first and second playing surfaces for the two game boards. According to the concepts of this invention.
Figure 2:
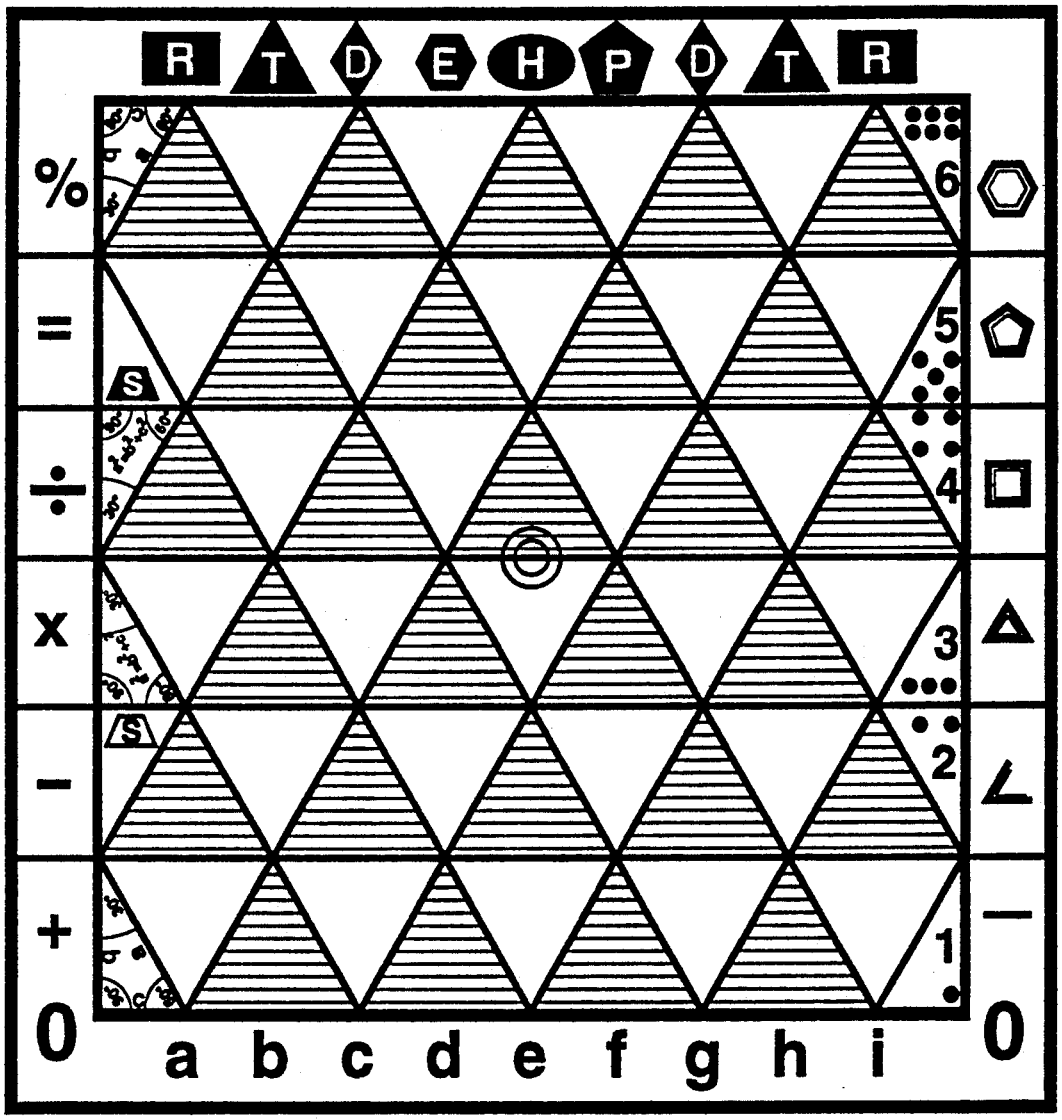
Figure 3:
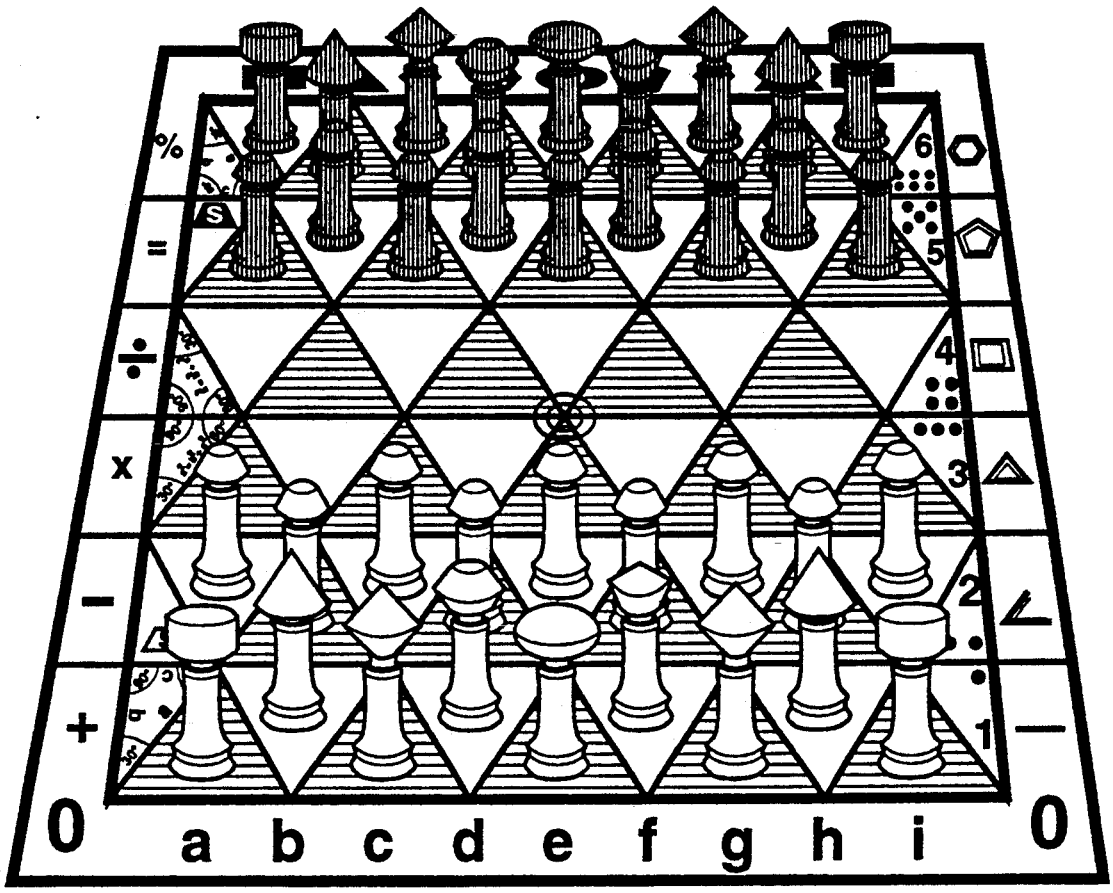
FIG. 3 is a view of the present invention, with the two sets of opponent three-dimensional game pieces, light and dark, placed on the first playing surface in the initial formation to begin the game.
Figure 4:
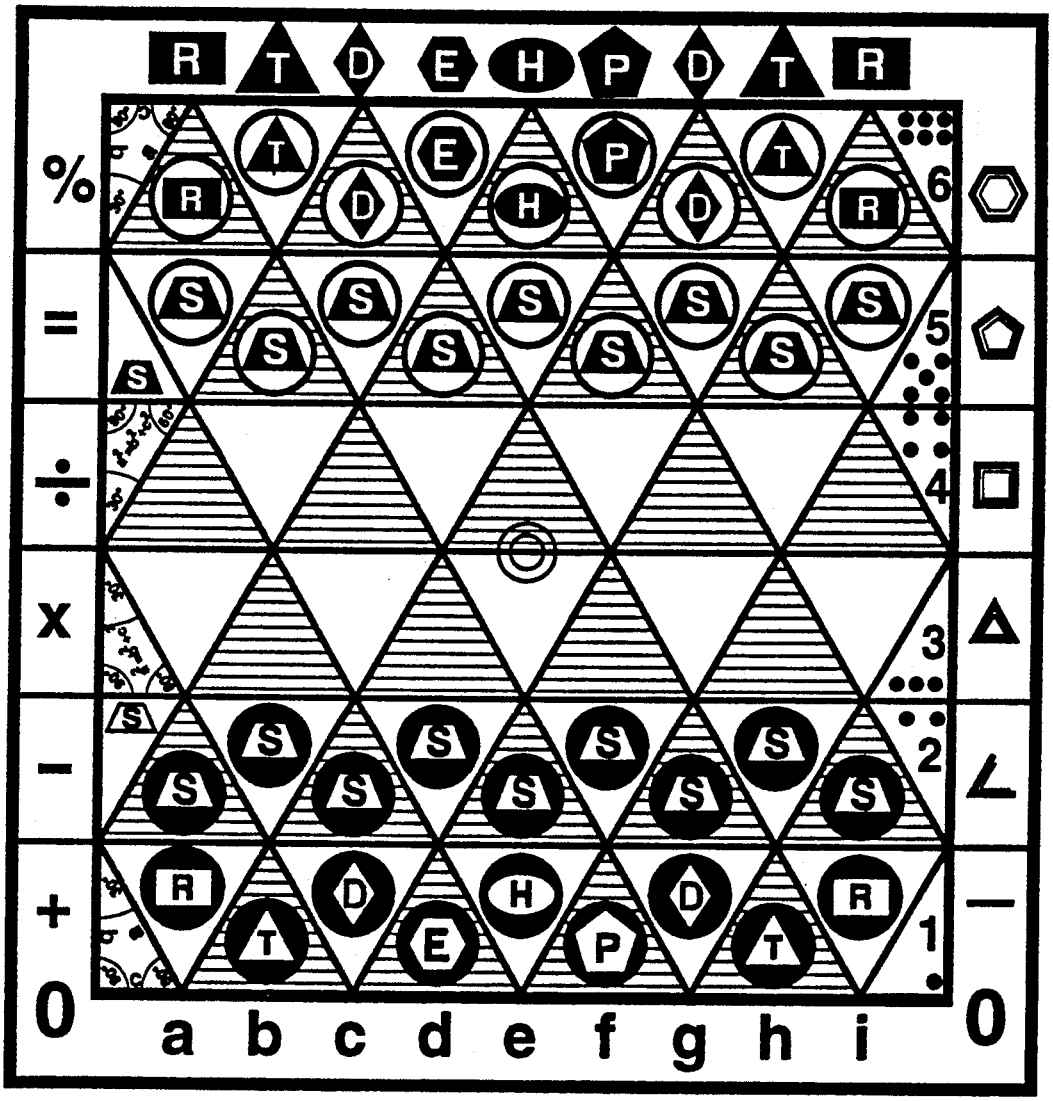
FIG. 4 is a view of the present invention, with the two sets of opponent geometrical game chips, light and dark, placed on the second playing surface in the initial formation to begin the game.

FIGS. 1 and 2 show two arrangements for the playing board. The board is a rectangle made up of 54 equilateral triangular spaces of two alternating colors or backgrounds. The triangular spaces of different color or background are separated by the sides, and united by the extreme angles of semi-plains divided by three alternate equal angles. The triangles of the same color form saw-toothed rows.

Combining the triangles of both colors or backgrounds, form horizontal and inclined rows, vertical and inclined columns, hexagons, trapeziums, parallelograms, rhombuses, polygons of five and six sides, in addition to other geometrical shapes.

The board has six horizontal rows, coded with numbers from 1 (one) to 6 (six) to the right of the rows from the bottom to the top, and nine vertical columns coded with lower case letters, from "a" to "i" in the lower margin, from the left to the right. Each triangular space of the board is in or belongs to a vertical column, as well as a horizontal row; therefore, each triangular space of the board has a code composed of a letter from the vertical column and a number from the horizontal row that it is in.

At the right side of the board, in the right triangles that are inside of the inner rectangle, the rows are enumerated from 1 (one) to 6 (six) with numbers and dots, from the bottom to the top. This corresponds to the numerical code of the 6 horizontal rows. In the right margin, between the inner and outer rectangles adjacent to the numbers:

a thick horizontal line for the number 1 (one);
a vector (two lines forming an angle) for the number 2 (two);
a triangle for the number 3 (three);
a square for the number 4 (four);
a pentagon for the number 5 (five); and
a hexagon for the number 6 (six).

Two small concentric circles in the center of the board are marks to distinguish the center of the two forms of the board.

At the left side of the board, in the right triangles that are inside of the inner rectangle: the sides and the angles of a right triangle are marked and the Pythagorean theorem $a^2=b^2+c^2$ is given.

In the right triangle located at the far left of row 5 is a dark background trapezium.

In the right triangle located at the far left of row 2 is a light background trapezium.

The letter (S) in the center of both trapeziums.

These symbols show that the second horizontal row is occupied by the 9 light colored sems, and the fifth horizontal row is occupied by the 9 dark sems in the initial position to begin the game.

In the left margin of the board, between the inner and outer rectangles at the prolongation of the horizontal rows:

the addition symbol (+) for the first row;
the subtraction symbol (−) for the second row;
the multiplication symbol (×) for the third row;
the division symbol (÷) for the fourth row;
the equality symbol (=) for the fifth row; and
the percentage symbol (%) for the sixth row.

In the upper margin of the board, between the outer and inner rectangles:

above the extreme columns of vertical rhombuses (a6) and (i6), dark rectangles with the letter (R) inside;
above the second and eighth vertical columns (b6) and (h6), dark triangles with the letter (T) inside;
above the third and seventh vertical columns (c6) and (g6), dark diamonds with the letter (D) inside;
above the fourth and sixth vertical columns (d6) and (f6), a dark hexagon and a dark pentagon with the letter (H) and letter (P) inside each of them respectively;
above the fifth vertical column (e6), a dark ellipse with the letter (O) inside.

In the lower margin of the board, between the outer and inner rectangles, lower case letters from the left to the right a, b, c, d, e, f, g, h, i, lined up with the vertical columns. These letters are the alphabetical code of the 9 vertical columns.

A zero (0) in each extreme of the lower left corner and the lower right corner of the margin.

The form of the spaces (triangular) and the colors (dark and light) on the board have:

a) Vertical columns of dark and light triangular spaces, forming triangles and rhombuses or diamonds of two colors from top to bottom, and vice versa.

b) Inclined columns of triangular spaces, forming triangles and rhombuses or diamonds of two colors from the left to the right, from top to bottom, and vice versa.

c) Inclined columns of triangular spaces, forming triangles and rhombuses or diamonds of two colors from the right to the left, from top to bottom, and vice versa.

d) Horizontal rows of triangular spaces of two alternating colors, forming enlarged normal or inverted trapeziums of nine triangles in each one, from the left to the right, from top to bottom, and conversely.

e) Inclined rows of triangular spaces of two alternating colors, forming enlarged trapeziums, from the left to the right, from top to bottom, and conversely.

f) saw-toothed rows of triangular spaces of the same color within each row:
saw-toothed rows of light color;
saw-toothed rows of dark color.

g) Inclined rows of triangular spaces of two alternating colors, forming enlarged trapeziums, from the right to the left, from top to bottom, and vice versa.

Chart 1 is a synthetic table of the most important features and characteristics of the board game according to the present invention.

| | Description | Quantity |
|---|---|---|
| A. | Spaces of the board | 54 |
| B. | Number of pieces per player | 18 |
| C. | Directions of the spaces of the board | 18 |
| D. | Different columns* | 3 |
| E. | Different rows* | 6 |
| F. | Dimensions per row of two colors | 2 |
| G. | Dimensions per saw-toothed row | 1 |
| H. | Dimensions per column of two colors | 1 |
| I. | Colors or backgrounds of the boards | 2 |
| J. | Different shapes in the boards | 6 |
| K. | Triangular spaces per horizontal row | 9 |
| L. | Triangular spaces per vertical column | 6 |

*Meaning it goes in two ways (forward and backward) as one.

There are two versions of the game pieces:

a) Two-dimensional version. These are flat, circular light and dark colored figures, with the geometrical representation of each game piece on one side and magnetic base on the other side. Both sides of the circular chips are flat, with geometrical figures representing the upper part of the three-dimensional game pieces, in drawing or by a raised design, contrasting the color of the figure with the background of the chip, and with letters contrasting with the color of the figures inside of them.

The geometrical representations of the game pieces on the circular chips of this version come from the shadows projected by the upper part of the three-dimensional version without taking into consideration the pillars that are common to all of them. The circular form is the symbolic expression of the perpendicular view from above each three-dimensional game piece.

The sem (S) is represented by a trapezium.
The tri (T) is represented by an equilateral triangle.
The dia (D) is represented by a rhombus or a diamond.
The rec (R) is represented by a rectangle.
The penta (P) is represented by a pentagon.
The hexa (H) is represented by a hexagon.
The ova (O) is represented by an ellipse or an oval.

b) Three-dimensional version. These are solid figures, with magnetic bases with pillars at the lower part as the seat of the pieces. The upper part each piece is what differentiates them, one from another.

The sem (S) has the upper part in the form of an inverted semi-cone with the wide side as the base of it. A small pillar supports the base of the semi-cone in the middle, and that small pillar connects to a bigger pillar beneath it.

The tri (T) has the upper part in the form of an inverted cone with the wide part as the base of it. A small pillar supports the base of the cone in the middle, and that small pillar connects to a bigger pillar beneath it.

The dia (D) has the upper part in the form of two cones joined at their bases with the wide sides united. One of the tips is joined to a small pillar that supports the double-cone in the middle, and that small pillar connects to a bigger pillar beneath it.

The rec (R) has the upper part in the form of a short cylinder. A small pillar supports one of the bases of the cylinder in the middle, and that small pillar connects to a bigger pillar beneath it.

The penta (P) has the upper part in the form of a circular house, with a sharp-pointed roof at the top center, sloped outward from the tip (inclined from the center toward the edges). The walls slope inward from top to bottom; with a flat base. A small pillar supports the flat base of the circular house in the middle, and that small pillar connects to a bigger pillar beneath it.

The hexa (H) has the upper part in the form of two semi-cones (two-semi-conical), united by the wide parts, with the narrow parts at the top and the bottom. A small pillar supports the "two-semi-cone" in the middle, and that small pillar connects to a bigger pillar beneath it.

The ova (O) has the form of a sphere flattened at the poles. A small pillar supports the squashed sphere in the middle, and that small pillar connects to a bigger pillar beneath it.

The game pieces are initially placed on rows 1, 2, 5, and 6 to begin the game.

The 9 light colored sems are placed on the 9 triangular spaces of row 2.

The 2 light colored recs are placed on the (a1) (i1) triangular spaces of row 1.

The 2 light colored tris are placed on the (b1) and (h1) triangular spaces of row 1.

The 2 light colored dias are placed on the (c1) and (g1) triangular spaces of row 1.

The light colored hexa is placed on the (d1) triangular space of the first horizontal row of the board.

The light colored ova is placed on the (e1) triangular space of row 1.

The light colored penta is placed on the (f1) triangular space of row 1.

The 9 dark sems are placed on the 9 triangular spaces of row 5.

The 2 dark recs are placed on the (a6) and (i6) triangular spaces of row 6.

The 2 dark tris are placed on the (b6) and (h6) triangular spaces of row 6.

The 2 dark dias are placed on the (c6) and (g6) triangular spaces of row 6.

The dark hexa is placed on the (d6) triangular space of row 6.

The dark ova is placed on the (e6) triangular space of row 6.

The dark penta is placed on the (f6) triangular space of row 6.

The general rules of movement are as follows:

The game pieces can be moved to or through triangular spaces that are unoccupied by other game pieces of the same color.

The game pieces of one color can capture and occupy the triangular spaces of the game pieces of the other color that are in the range of their reach, or that they encounter in the direction of their movements.

The game pieces of one color cannot be moved beyond one or several game pieces of the other color that block the triangular spaces in the direction of their movements.

The particular rules of movement are as follows:

The game pieces that fly, or jump, can be moved to the triangular spaces that are unoccupied, or are occupied by game pieces of the other color.

The game pieces that fly, or jump, can be moved to pass over game pieces of the same or other color.

The game pieces that fly, or jump, cannot be moved to the triangular spaces that are occupied by game pieces of the same color.

The ova (O) cannot be moved to any triangular space that is within range of attack of the pieces of the opposite color.

Figure 5:
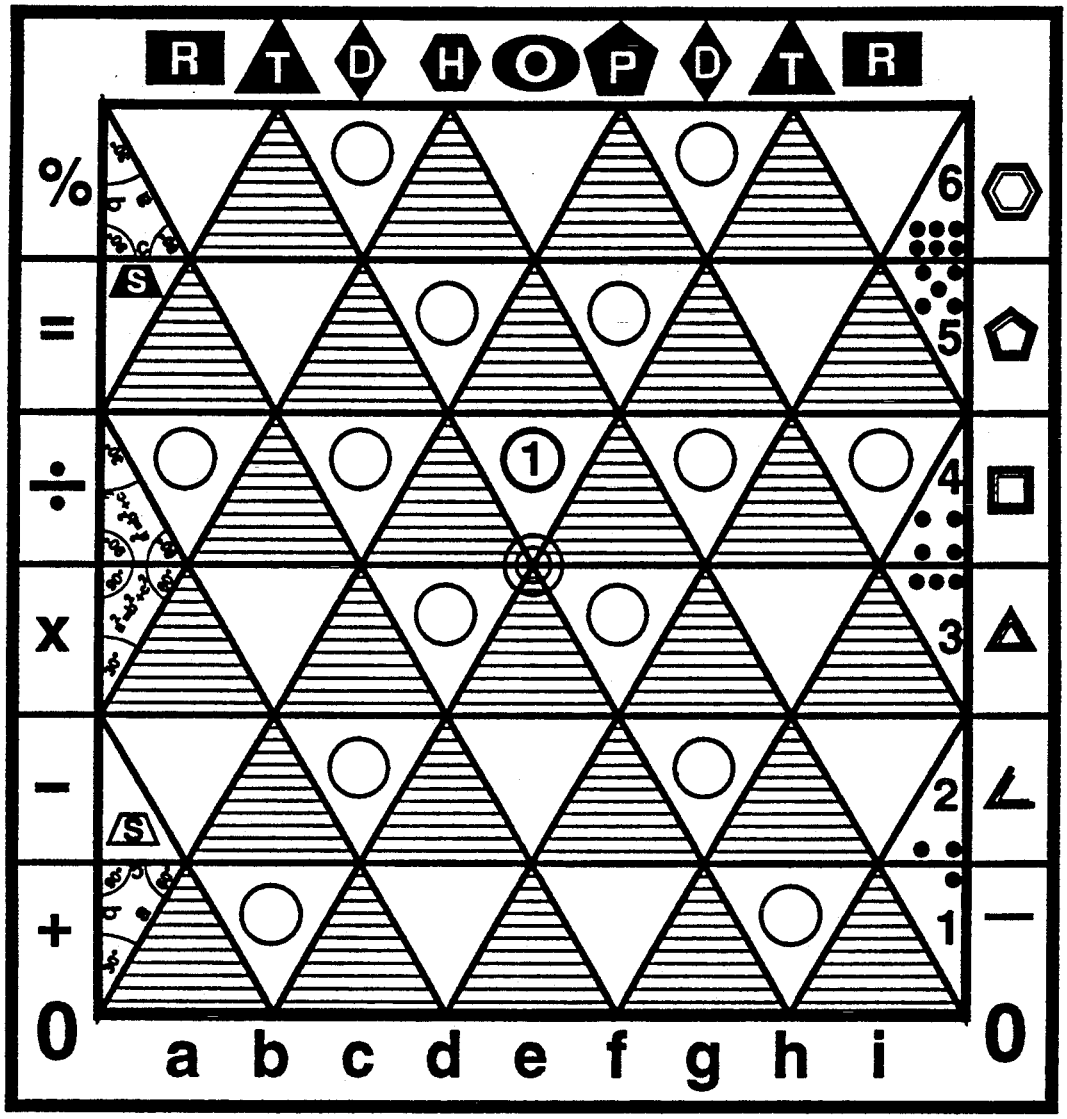
FIG. 5 is a view of the game board according to the present invention showing the basic movement #1, which consists of movement on the spaces of the same color in all six directions from the starting point.

The basic movements are as follows:

Movement #1: movement through the triangles of the same color, on the saw-toothed rows of triangular spaces in all six different directions from the original position, FIG. 5.

Figure 6:
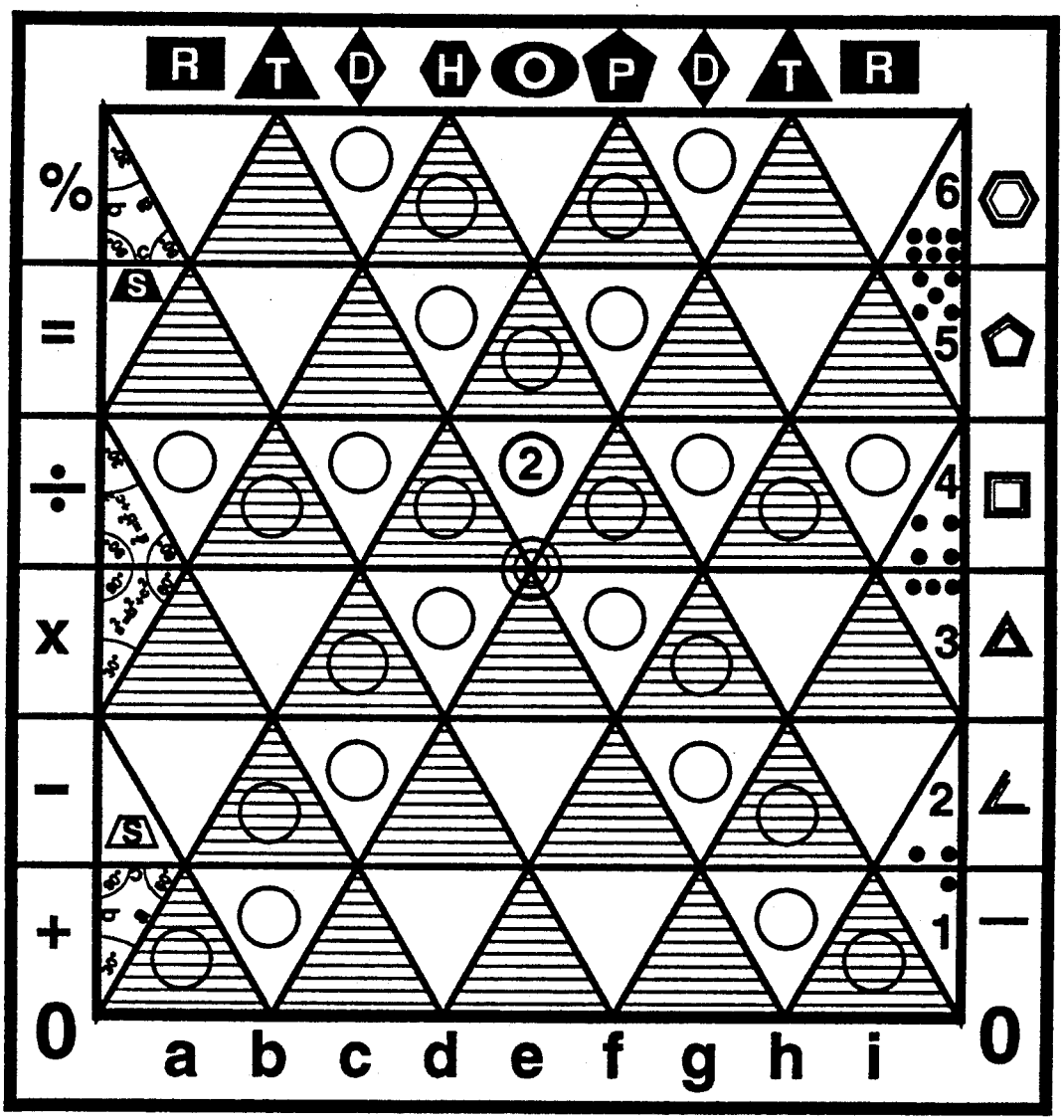
FIG. 6 is a view of the game board according to the present invention showing the basic movement #2, which consists of movement through the spaces of two colors on the rows in all six directions from the starting point.

Movement #2: movement through the triangles of two colors, on the rows of enlarged parallelograms in all six different directions from the original position, FIG. 6.

Figure 7:
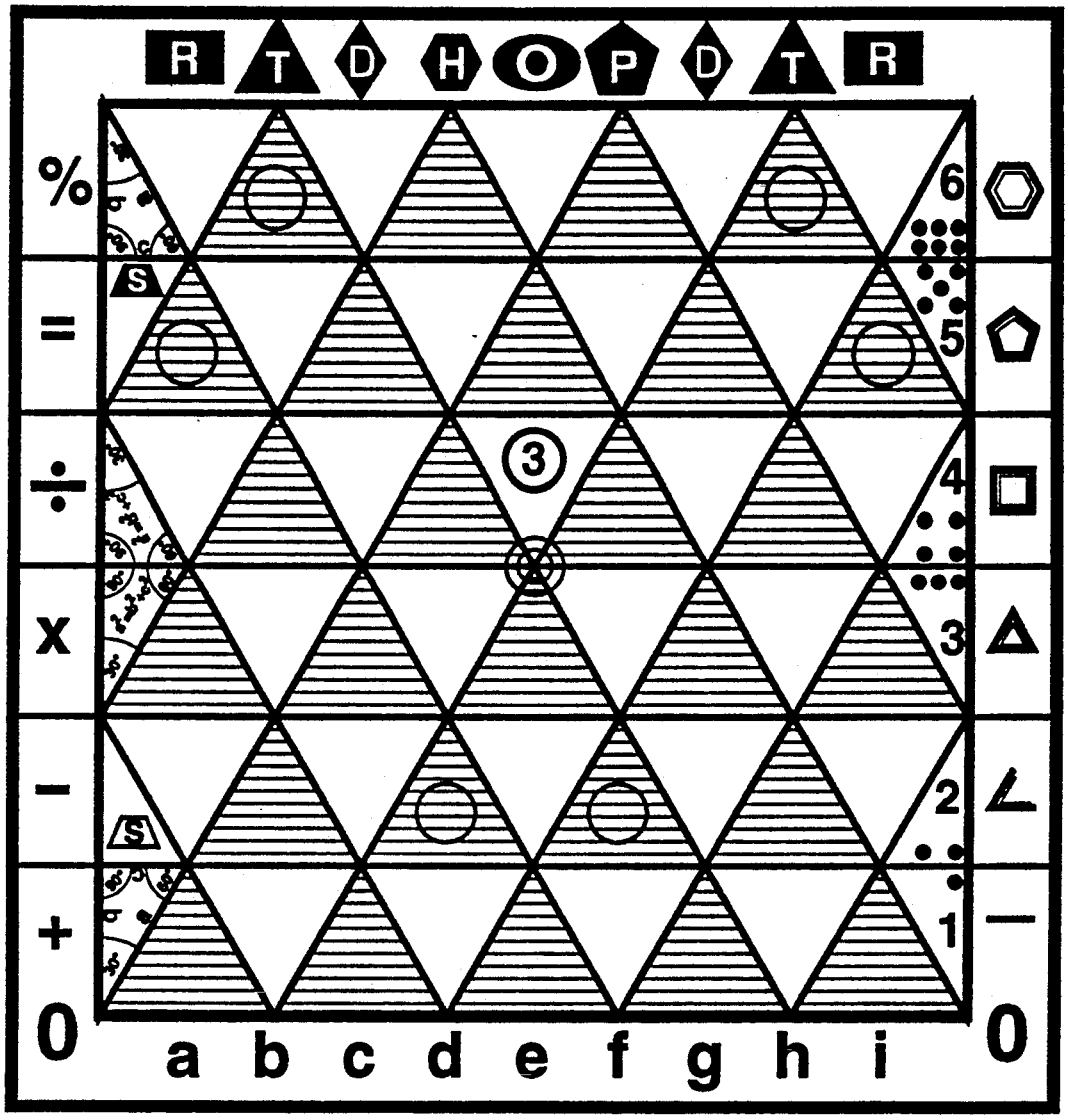
FIG. 7 is a view of the game board according to the present invention showing the basic movement #3, which consists of jumping from a space of one color to another space of different color, through the opposite angles toward the opposite angular corners of a bigger triangle made up of four triangles, having the original opposite triangle in one vertex (apex). The triangles of departure and arrival are always of different color.

Movement #3: movement of flight, or jump, that consists in going from one triangle to the following triangle through the opposite angles, then going to either of the two adjacent triangles of the same color that are in front of the original opposite angle, such as, the triangles of departure and arrival are of different color, and vice versa, FIG. 7.

Figure 8:
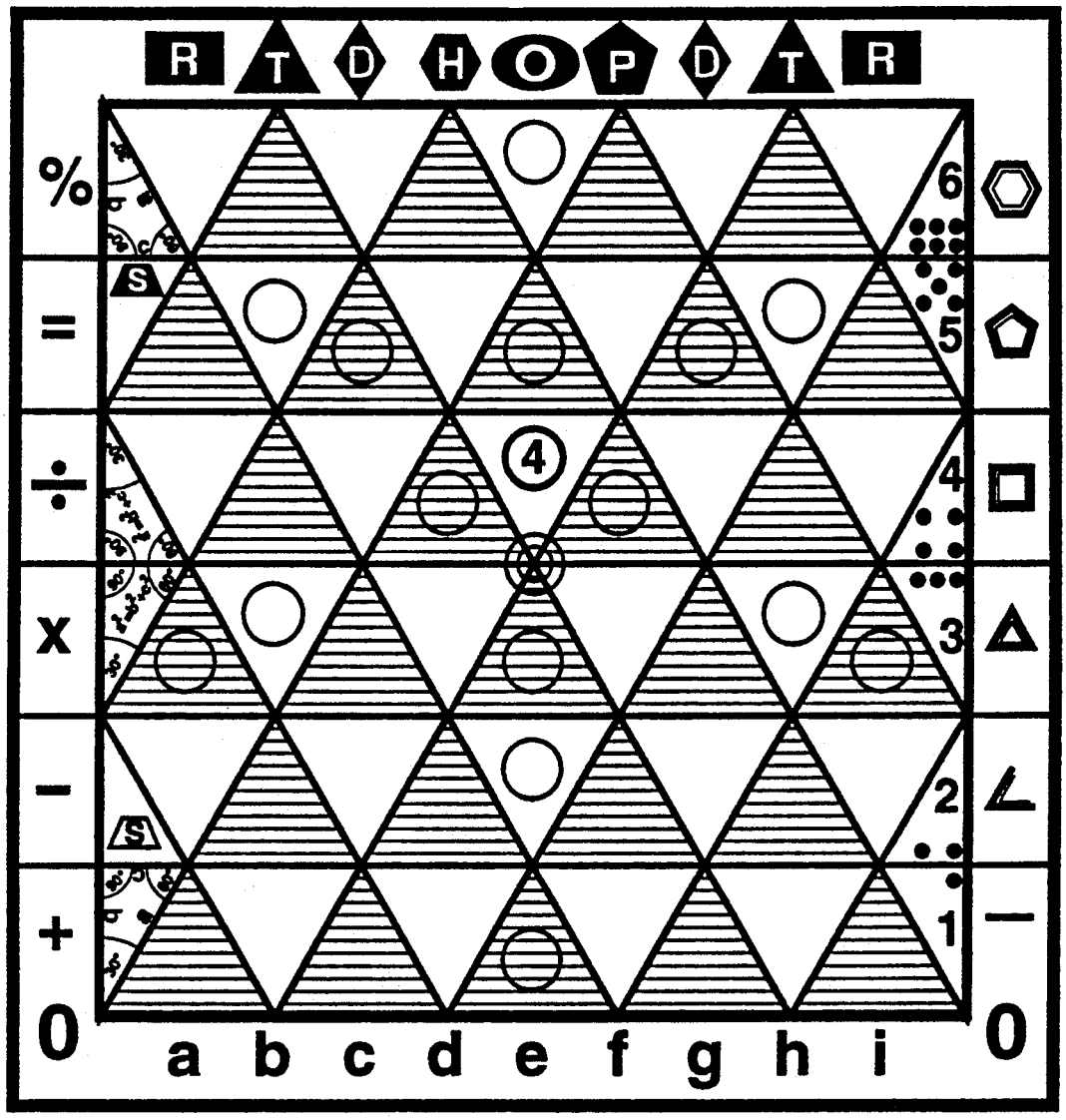
FIG. 8 is a view of the game board according to the present invention showing the basic movement #4, which consists of movement through the spaces of two colors on the columns of triangles and rhombuses.

Movement #4: movement through the triangles of two colors, on the columns of straight diamonds or rhombuses in all six different directions from the original position, FIG. 8.

Chart 2 is a synthetic table of the different movements of the game.

| | Description | Quantity |
|---|---|---|
| A. | Basic movements | 4 |
| B. | Combined movements | 5 |

Figure 9:
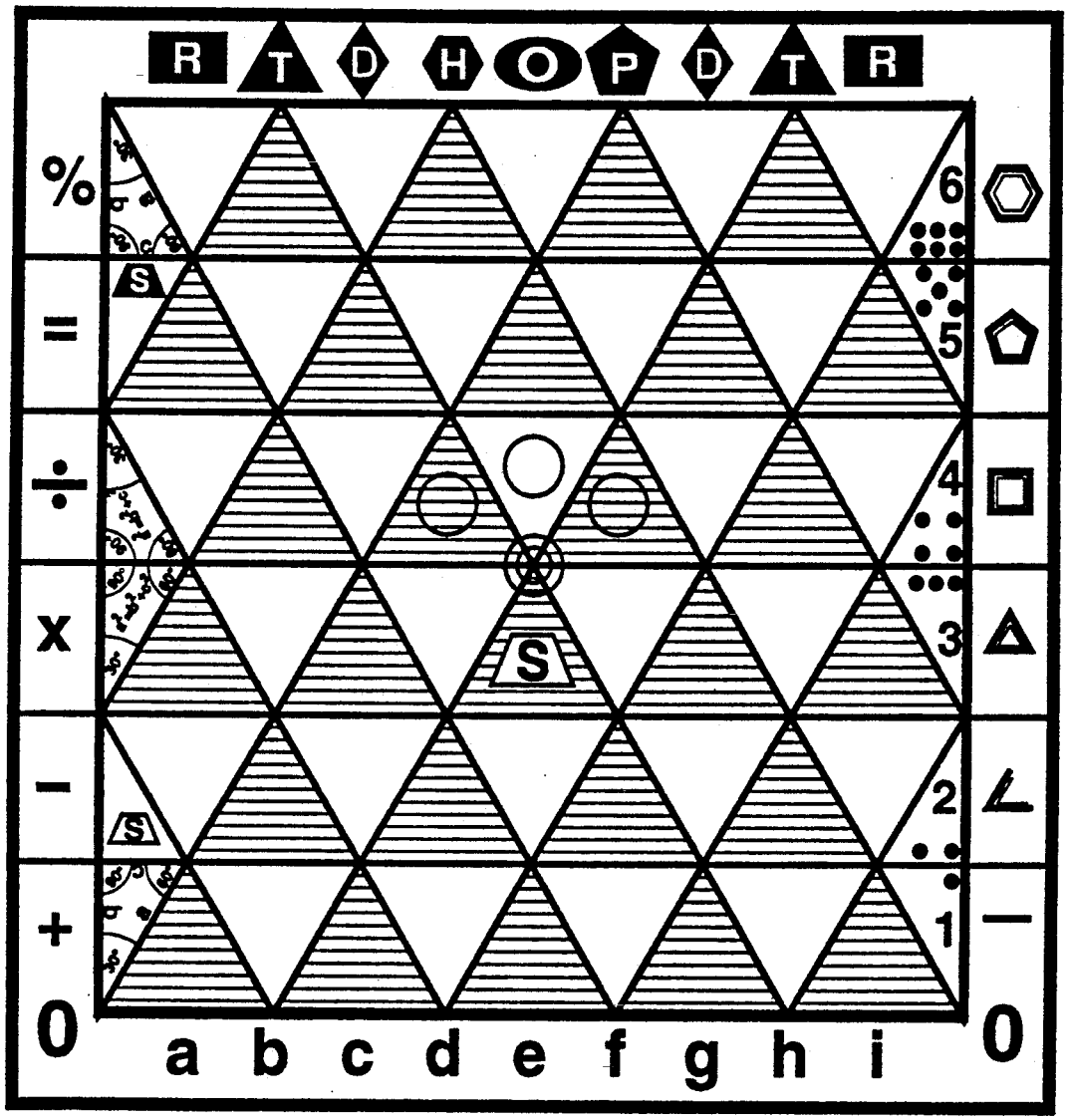
FIG. 9 is a view of the game board according to the present invention showing the sem's movements. It always moves forward to any of the three central triangular spaces next to the original position as long as those spaces are unoccupied by any other game piece of the same color.
Figure 10:
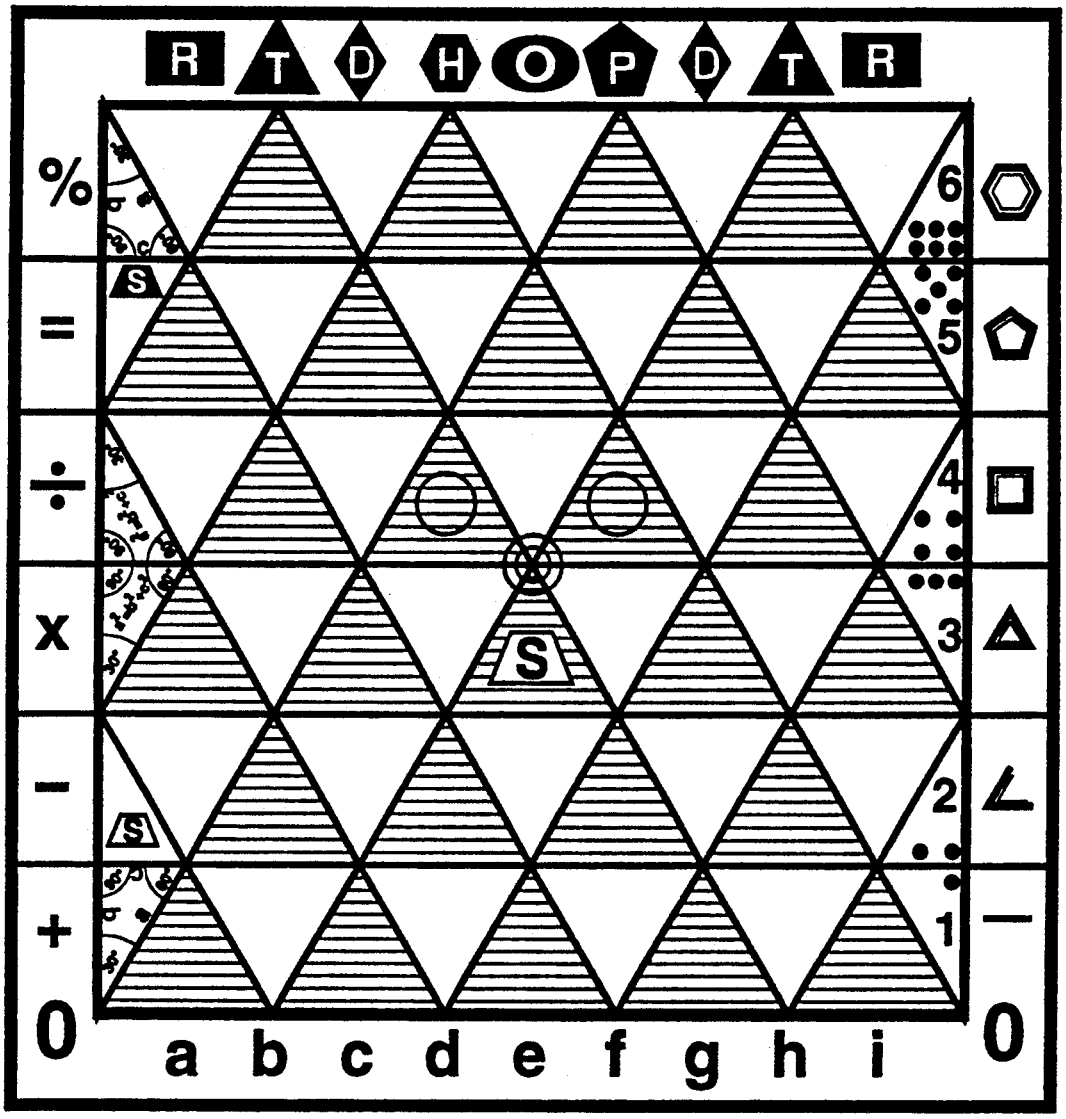
FIG. 10 is a view of the game board according to the present invention showing the way that the sem captures. It captures any opponent game piece that is on either of the two forward central triangular spaces of the same color in the row ahead of the original position.

The movements of the pieces are as follows:

The sem (S) moves one triangle to any of the three forward central spaces that form a normal or inverted horizontal trapezium (FIG. 9); and it captures on the two spaces of the same color of the same trapezium (FIG. 10). When the sem arrives at the last row ahead of the row of departure, it is promoted to another piece except the ova or sem.

Figure 11:
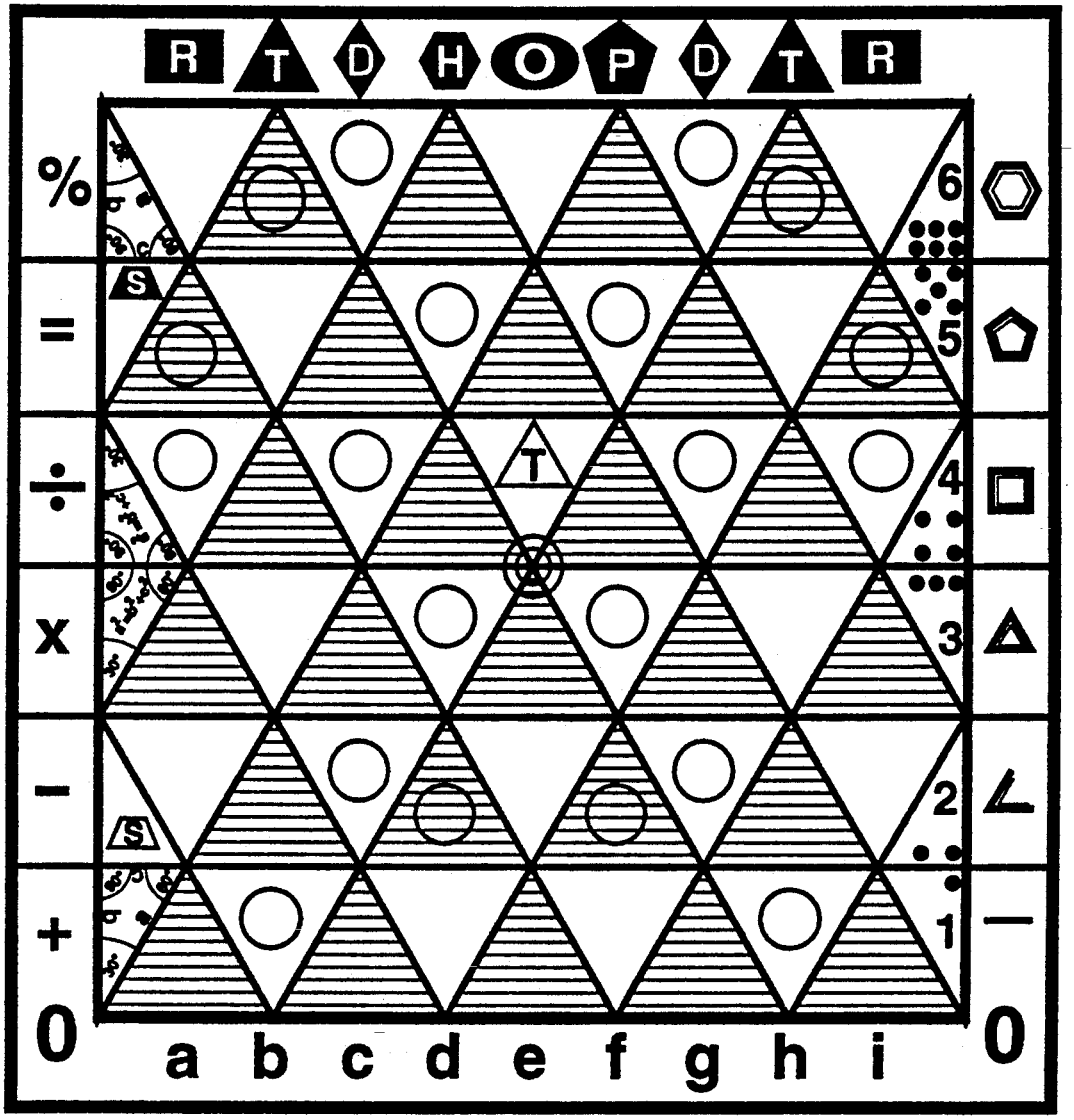
FIG. 11 is a view of the game board according to the present invention showing the tri's movements, which consist of movements #1 and #3.

The tri (T) moves through the spaces of the same color forming saw-toothed rows-movement #1, and jumps from one space to another space of different color movement #3 (FIG. 11).

Figure 12:
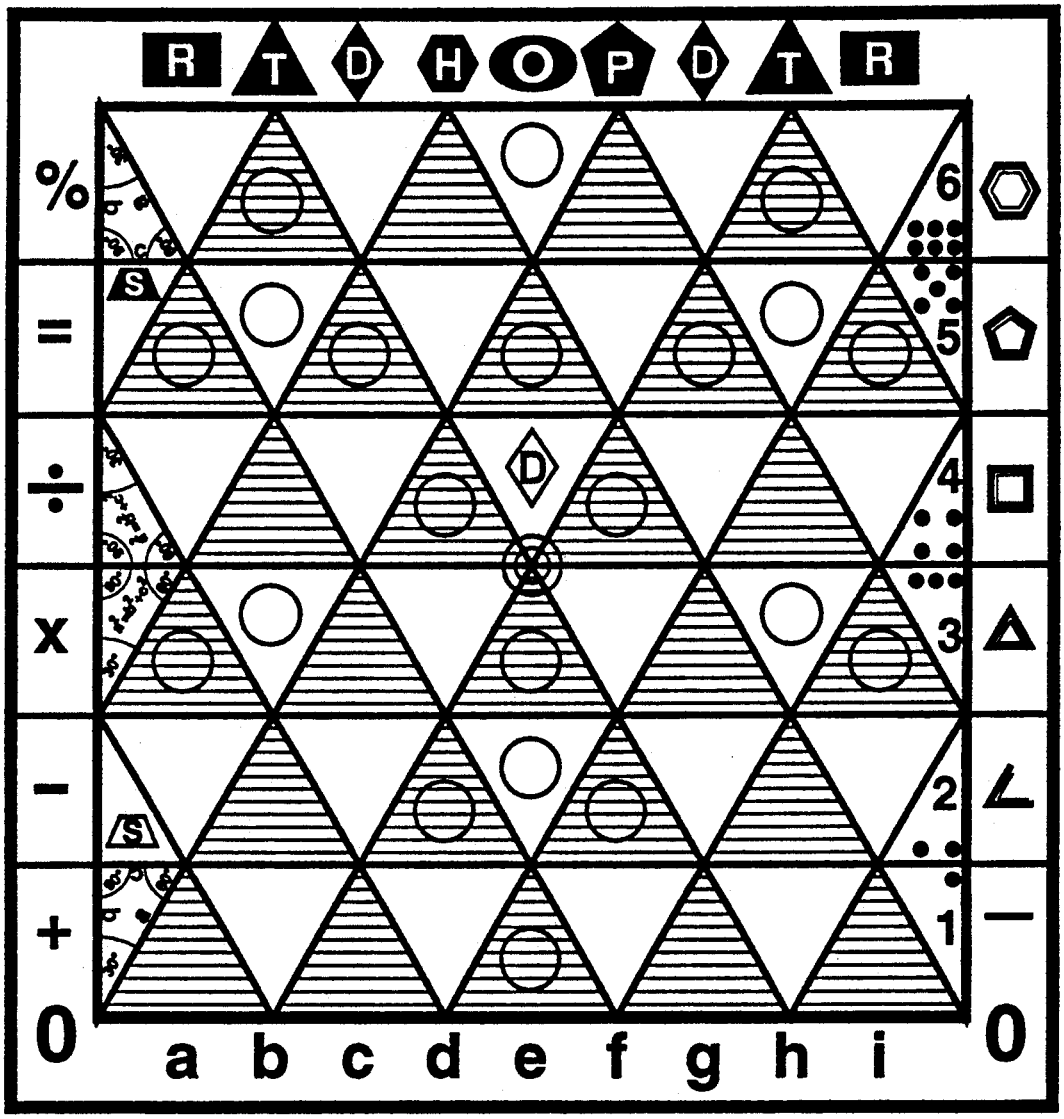
FIG. 12 is a view of the game board according to the present invention showing the dia's movements, which consist of movements #3 and #4.

The dia (D) moves through the triangles of two colors forming columns of straight rhombuses or diamonds-movement #4, and jumps from one space to another space of different color-movement #3 (FIG. 12).

Figure 13:
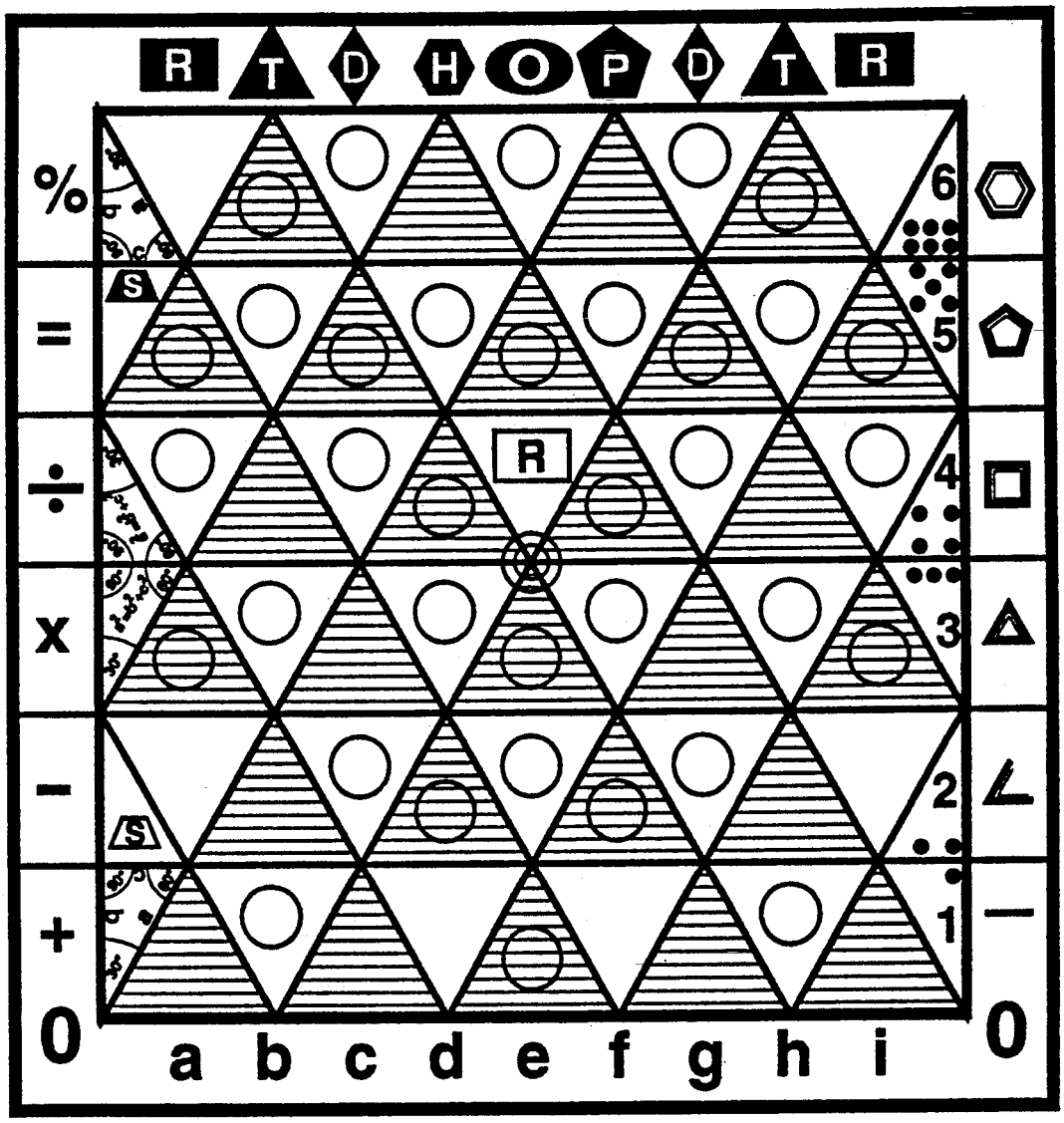
FIG. 13 is a view of the game board according to the present invention showing the rec's movements, which consist of movements #1, #3 and #4.

The rec (R) moves through the spaces of the same color forming saw-toothed rows-movement #1, through the spaces of two colors forming columns of rhombus or diamonds-movement #4, and jumps from one space to another space of different color-movement #3 (FIG. 13).

Figure 14:
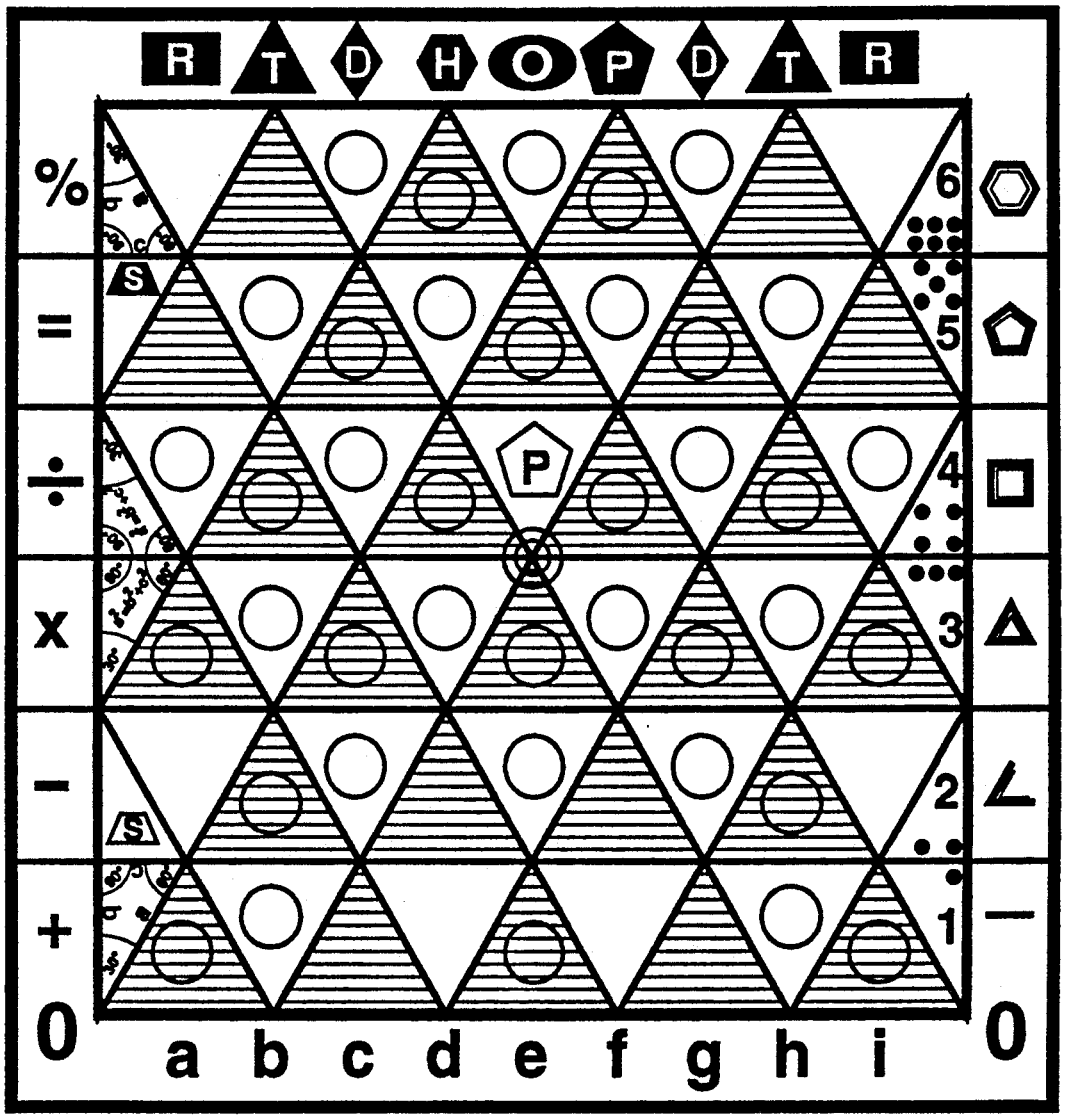
FIG. 14 is a view of the game board according to the present invention showing the penta's movements, which consist of movements #1, #2 and #4.

The penta (P) moves through the spaces of the same color-movement #1, through the spaces of two colors-movement #2, and through the spaces of two colors-movement #4 (FIG. 14).

Figure 15:
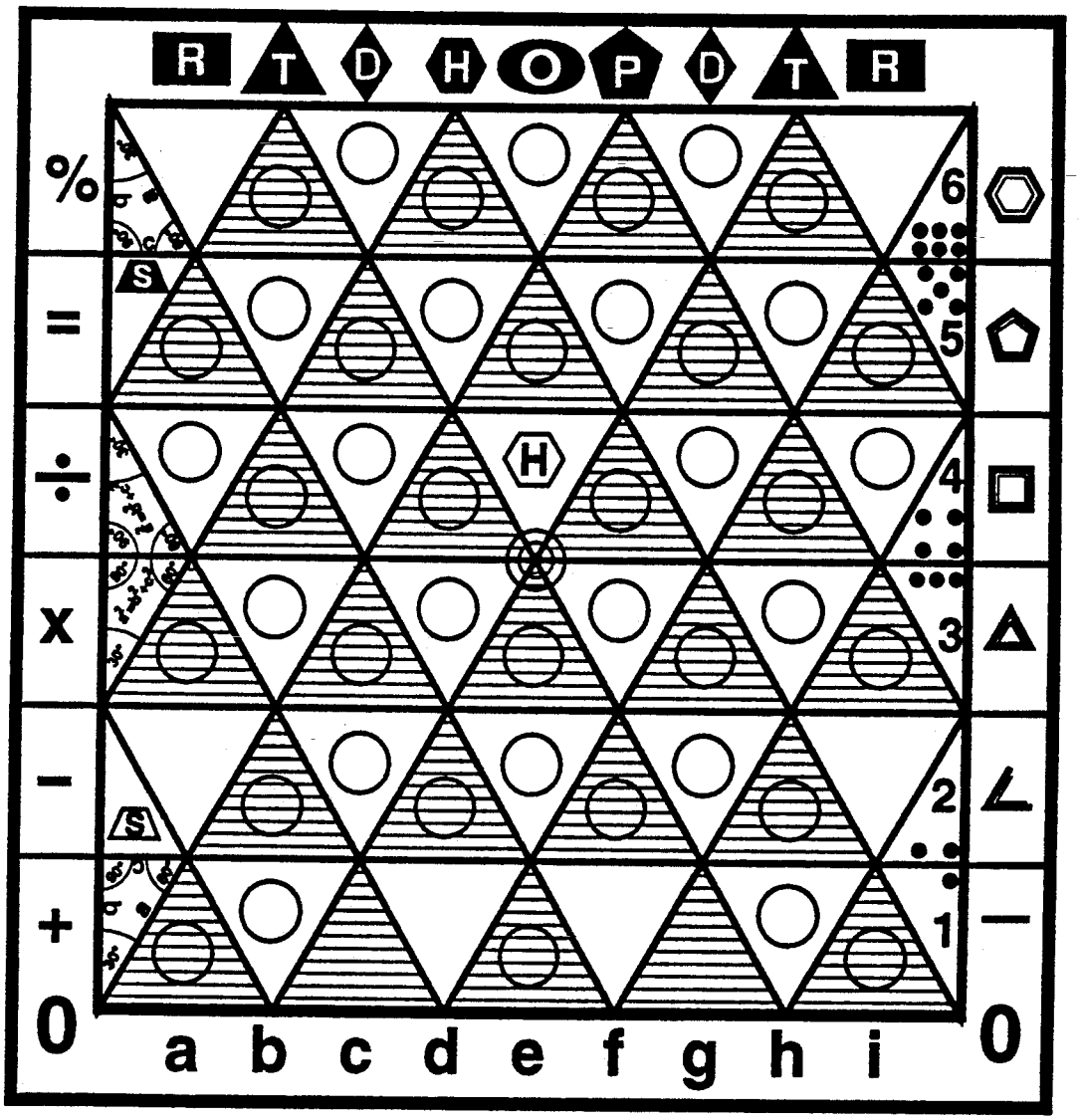
FIG. 15 is a view of the game board according to the present invention showing the hexa's movements, which consist of movements #1, #2, #3 and #4.

The hexa (H) moves through the spaces of the same color-movement #1, through the spaces of two colors-movement #2, through the spaces of two colors-movement #4, and jumps from one space to another space of different color-movement #3 (FIG. 15).

Figure 16:
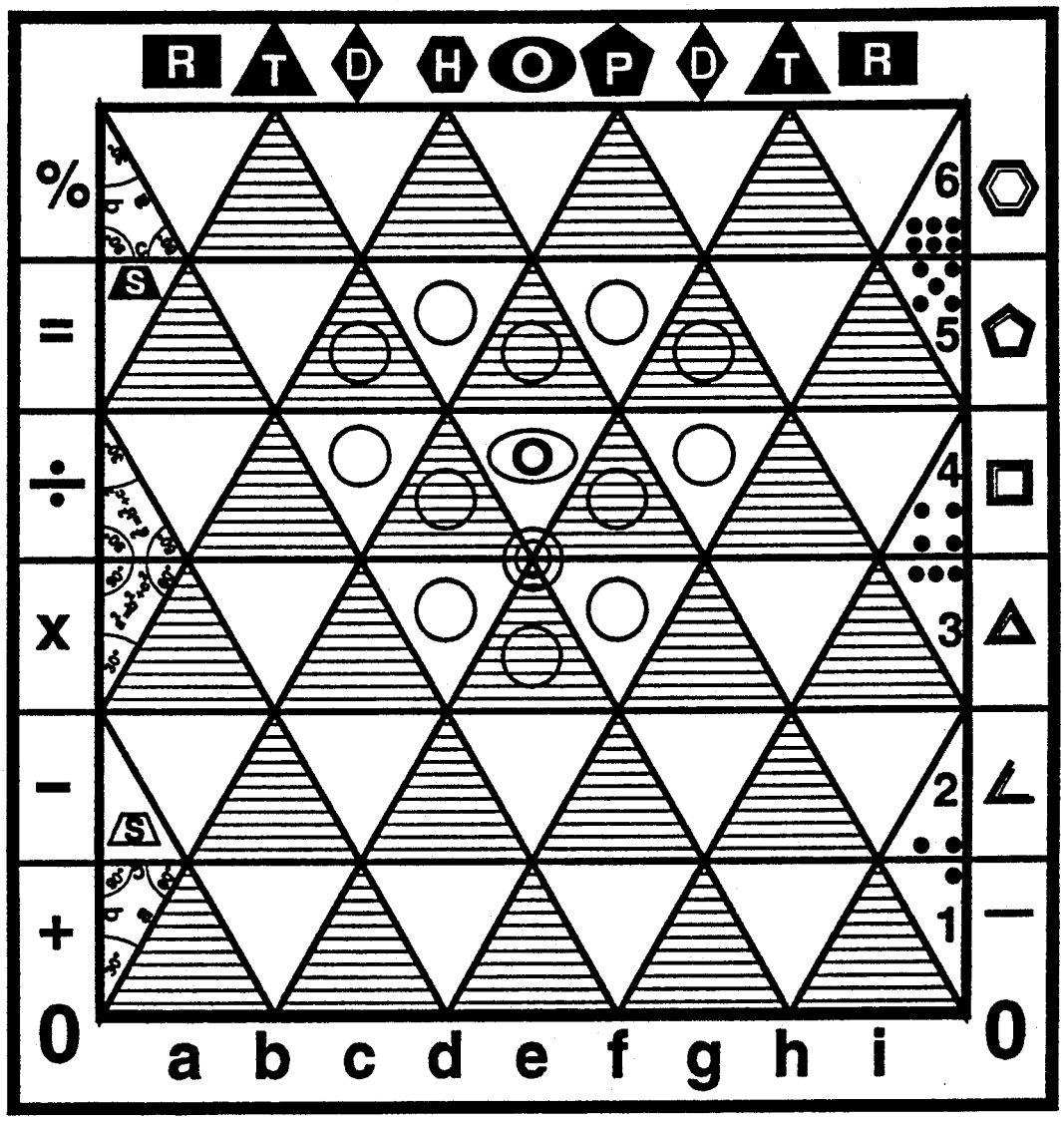
FIG. 16 is a view of the game board according to the present invention showing the ova's movements, from a central position of the board.
Figure 17:
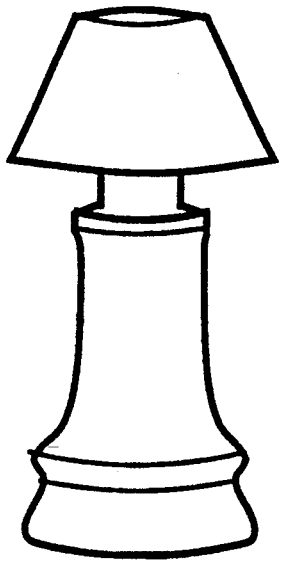
FIG. 17 is a perspective view of a three-dimensional sem.
Figure 18:
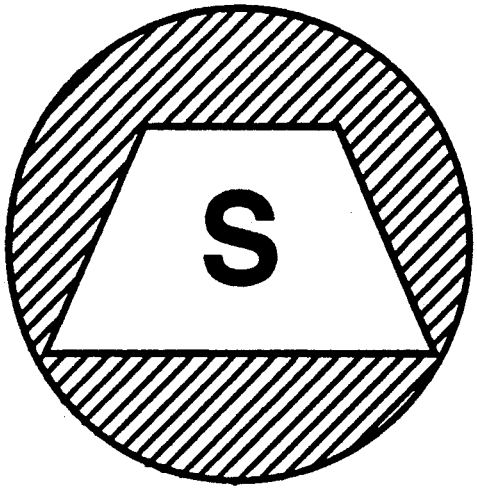
FIG. 18 is a view of a sem in a circular chip.
Figure 19:
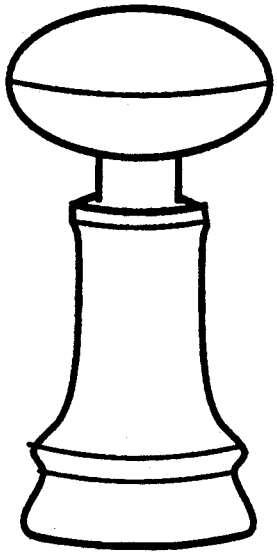
FIG. 19 is a perspective view of a three-dimensional ova.
Figure 20:
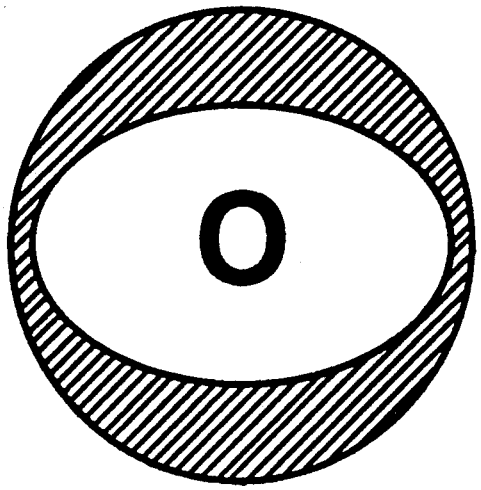
FIG. 20 is a view of an ova in a circular chip.
Figure 21:
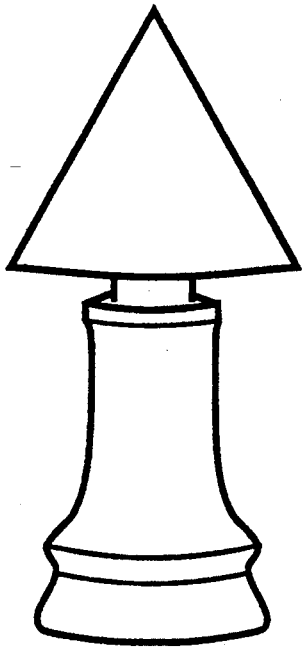
FIG. 21 is a perspective view of a three-dimensional tri.
Figure 22:
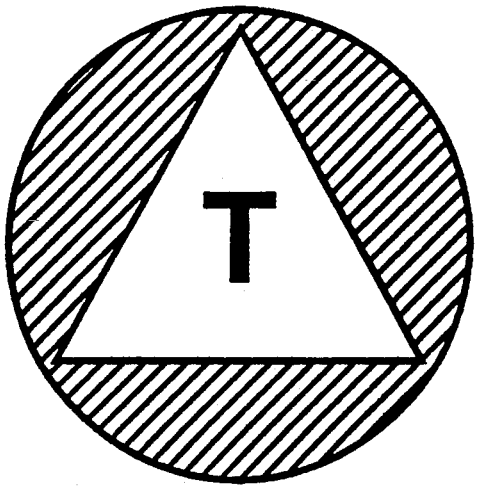
FIG. 22 is a view of a tri in a circular chip.
Figure 23:
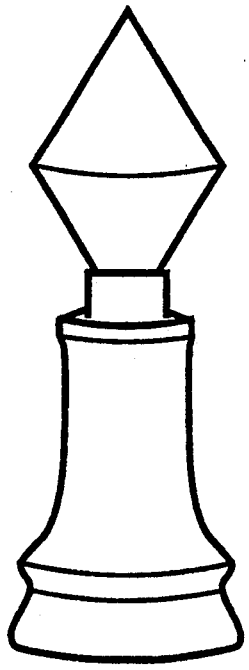
FIG. 23 is a perspective view of a three-dimensional dia.
Figure 24:
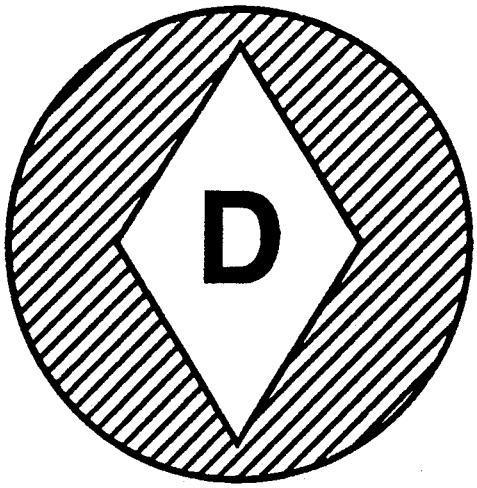
FIG. 24 is a view of a dia in a circular chip.
Figure 25:
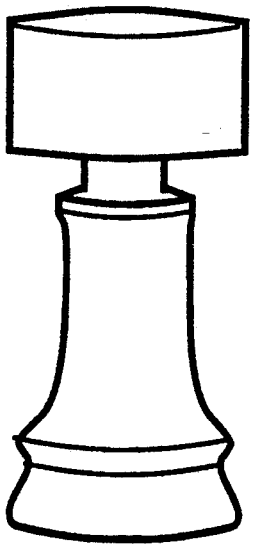
FIG. 25 is a perspective view of a three-dimensional rec.
Figure 26:
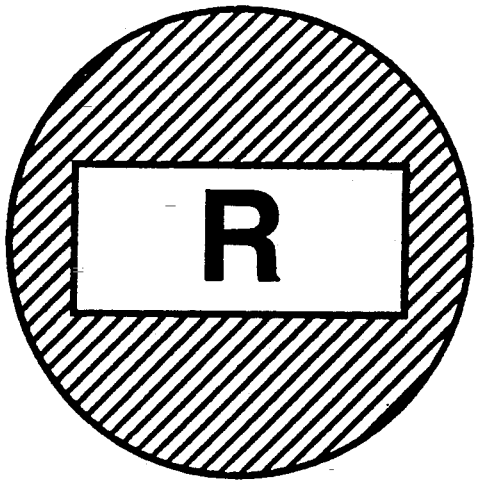
FIG. 26 is a view of a rec in a circular chip.
Figure 27:
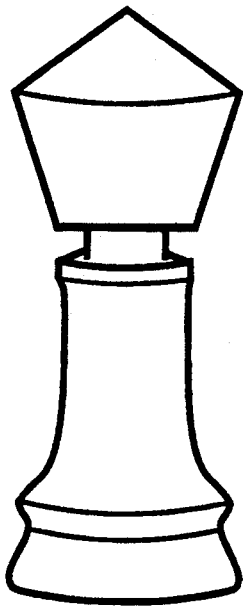
FIG. 27 is a perspective view of a three-dimensional penta.
Figure 28:
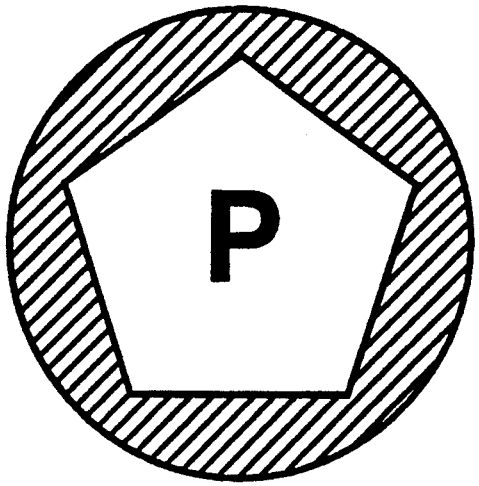
FIG. 28 is a view of a penta in a circular chip.
Figure 29:
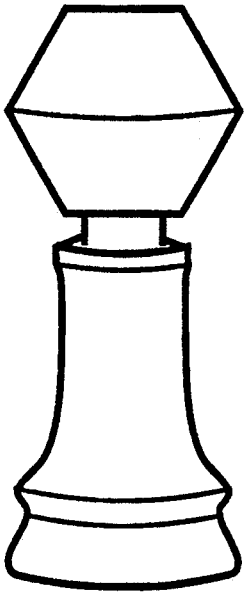
FIG. 29 is a perspective view of a three-dimensional hexa.
Figure 30:
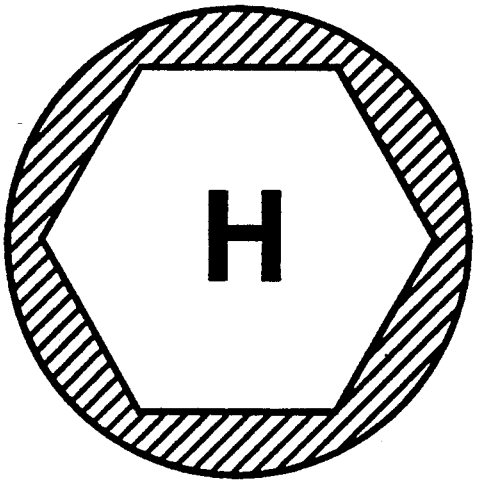
FIG. 30 is a view of a hexa in a circular chip.
Figure 31:
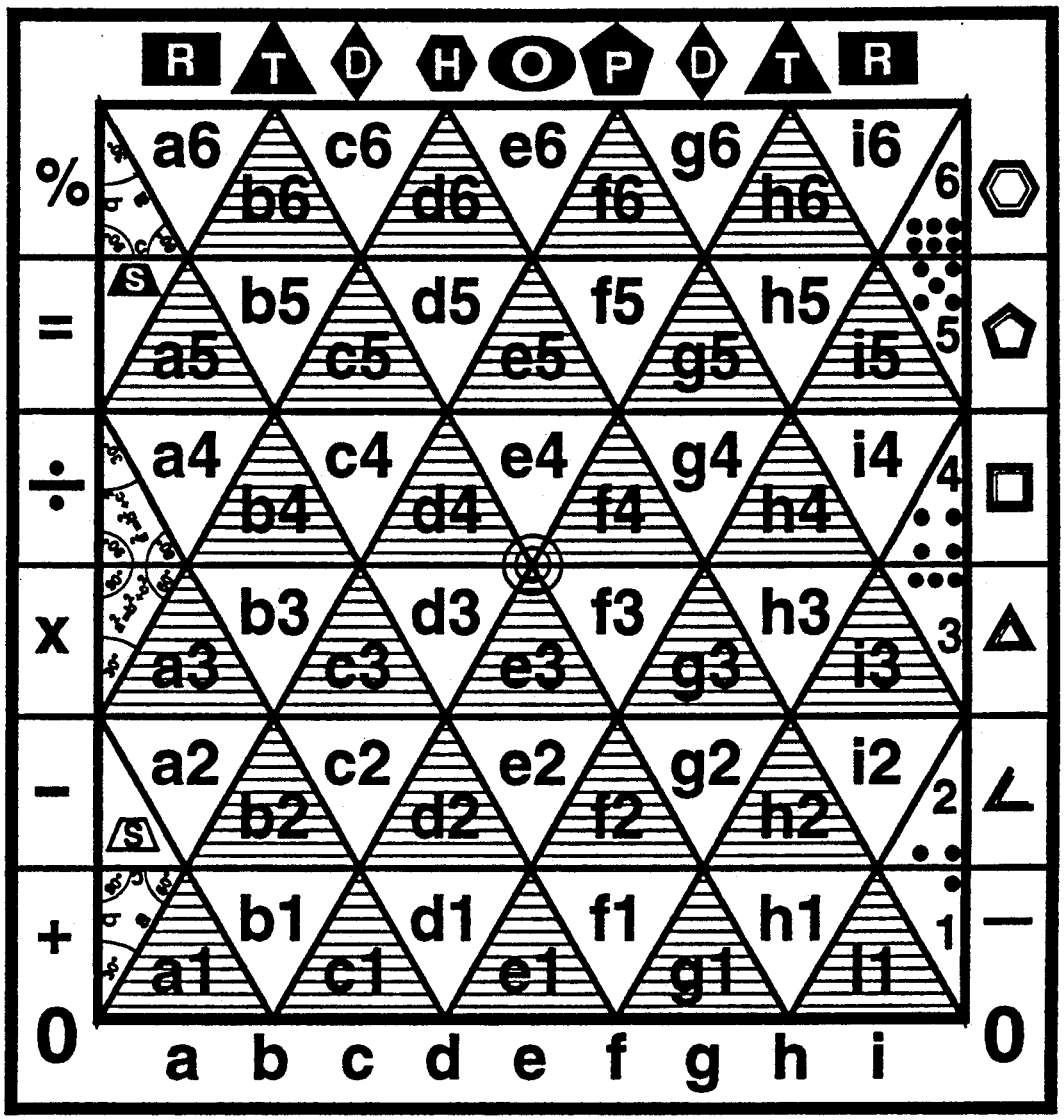
FIG. 31 is a view of the game board according to the present invention, with the coding of the board.

The ova (O) moves one space to any triangle around it that is connected by the sides or angles (FIG. 16). piece.

Chart 3 is a synthetic table of the movements of each game

| | Kind of pieces | Quantity |
|---|---|---|
| A. | Ova | 2 |
| B. | Hexa | 4 |
| C. | Penta | 3 |
| D. | Rec | 3 |
| E. | Dia | 2 |
| F. | Tri | 2 |
| G. | Sem* | 3-2 |

*Kind of movements (3), movements of capture (2).

Chart 4 is a synthetic table of the different directions of movement of each game piece.

| | Kind of pieces | Quantity |
|---|---|---|
| A. | Hexa | 24 |
| B. | Penta | 18 |
| C. | Rec | 18 |
| D. | Tri | 12 |
| E. | Dia | 12 |
| F. | Ova | 12 |
| G. | Sem | 3 |

Chart 5 is a synthetic table of the triangular spaces of the maximum range of each game piece.

| | Kind of pieces | Spaces |
|---|---|---|
| A. | Ova | 12 |
| B. | Hexa | 45 |
| C. | Penta | 39 |
| D. | Rec | 35 |
| E. | Dia | 21 |
| F. | Tri | 20 |
| G. | Sem* | 3-2 |

*Spaces of movement (3), spaces of capture (2).

The configuration of the spaces, the disposition of the colors on the horizontal rows of the board, and the rules of movement of the oval allow it to go from a triangle of one color to another of the same color on the horizontal rows, "passing over" the intermediate opposite colored triangular space that is between the two triangular spaces of the same color of the same horizontal row, even if the intermediate triangular space is:

a) occupied by another game piece of the same color;

b) occupied by another game piece of the opposing color that cannot threaten the ova;

c) threatened by one, or several game pieces of the opposing color through the projection of:

the vertical column of triangles and rhombuses of two colors that originates or ends in the intermediate triangular space;

the two saw-toothed inclined rows of triangular spaces of the same color that converge on the intermediate triangular space.

The movements on the horizontal rows are in reality two different movements:

a) movement through the saw-toothed rows of light colored triangles;

b) movement through the saw-toothed rows of dark triangles.

This movement of the ova through the triangular spaces of the same color on the horizontal rows is particular to the board game according to the present invention.

Additionally, the wider range of movements of the other pieces, particularly the rec, allows it to simplify the rules of the board game according to the present invention without undermining:

a) the ova's security;

b) the development of the pieces; and c) the possibilities of the game.

The movements, blockades, and captures of the pieces on the rows, have the following characteristics:

a) movement through the saw-toothed rows of light colored triangles;

b) movement through the saw-toothed rows of triangles of dark color;

c) partial blockade of the rows:

A game piece can blockade the prolongation of spaces of the same color of the occupied space on the same row.

A game piece cannot blockade the spaces of the opposing color of the occupied space on the same row;

d) total blockade of the rows:

Two game pieces can blockade the prolongation of a row if each game piece occupies spaces of the opposing color in the same row.

e) The penta, and the hexa can:

be moved along the rows of spaces that are not blockaded by game pieces of the same color, or the opposing color;

be moved to the spaces of light or dark color that are unoccupied, from a space of any color, as long as they are on the same row;

be moved "passing over" one or more game pieces of any color that partially blockade a row only to the spaces that are not blockaded, from a space of any color of the same row;

capture an opponent game piece that is far more distant than another game piece that partially blockades the row, if both of the opponent game pieces are on spaces of different colors, from a space of any color of the same row;

capture any of the two opponent game pieces that totally blockade the row (the two spaces of different colors).

The number of spaces that play on the game board (54) is less than the number of spaces of the boards of other well-known games. This simplifies the perspective of the board, the spaces of movement of the game pieces, and the possibilities of the game in comparison to other games.

Nevertheless, the characteristics of the boards that make possible the simplification of the rules of this game permit at the same time a wider range of movement and captures, a greater number of game pieces, a greater number of combinations of movements assigned to each of the game pieces, and, consequently, an increased power of movement and capture of each of the game pieces, a greater number of branchings (continuations) of each movement of each of the game pieces in comparison with other games. Because of the rules and movements of the board game according to the present invention, the probability of draw is reduced.

The object of the game is to surround or to corner the opponent's ova so that it cannot move to any other position without being captured. When the ova is threatened by an opponent piece, it can:

a) move to another space that is not attacked or threatened by any opponent's game piece;

b) place another game piece of the same color of the ova on the spaces between the ova and the threatening game piece;

c) capture the opponent's threatening game piece with the attacked ova, or with another game piece of the same color as the threatened ova.

If the threatened ova cannot make any of the three options, it is in final warning of immediate inevitable capture. The player who threatens the opponent's ova with immediate inevitable capture and that gives the final warning wins the game.

Following are samples and transcriptions of two games on the first playing surface.

| Game #1 | | Game #2 | |
|---|---|---|---|
| WHITE | BLACK | WHITE | BLACK |
| 1. f3 | 1. f4 | 1. d3 | 1. d4 |
| 2. g3 | 2. e4 | 2. c3 | 2. e4 |
| 3. d3 | 3. e4 × f3 | 3. f3 | 3. e4 × f3 |
| 4. e2 × f3 | 4. f4 × g3 | 4. e × f3 | 4. d4 × c3 |
| 5. D × g3 | 5. h4 ?? | 5. DH × c3 | 5. b4 ?? |
| 6. D3, e2 + | 6. O, f5 | 6. Dc3, e2 + | 6. O, d5 |
| 7. TP, e3 + | 7. O, h5 | 7. Tb, e3 + | 7. O, b6 |
| 8. f3, g4 + | 8. O × g4 | 8. d3, c4 + | 8. O × c4 |
| 9. De2, h3 + | 9. P, f3 | 9. De2, b3 + | 9. O, a4 |
| 10. P × P + | 10. O, i4 | 10. Db3, a3++ | 10. |
| 11. Dh3, i3++ | 11. | | |

Examples of other uses of the board game according to the present invention include:

a) To play conventional checkers with 9 chips of one color for one player and 9 chips of the opposing color of the other player.

b) As a decoration on furniture; tables, table runners, desks, etc.

c) As an object of pictures, canvas, posters, signs, etc.

d) As an adornment of carpets, bedspreads, tablecloth, curtains, etc.

e) As drawings on floor tiles, plastics, floors, ceilings, walls, etc.

f) As a frame, or design for crosswords, puzzles, word games, number games, geometrical figure games, etc.

g) As an educational instrument to teach some elements of geometry and mathematical principles.

h) As an instrument to practice spelling.

i) As an instrument to exercise and develop the capacities of concentration, analysis, abstraction, memory, calculation, projection, etc.

j) As a vertical board to do demonstrations.

k) As a basic design for dynamic games in computers.

I claim:

1. An apparatus for a playing game, said apparatus comprising:

first and second planar playing surfaces each having a rectangular perimeter, each of said first and second playing surfaces is divided into a plurality of playing spaces;

each of said plurality of playing spaces is a triangle having three sides and three angles, contiguous ones of said plurality of playing spaces share one coincident side; and first and second sets of playing pieces, each of said first and second sets of playing pieces including a plurality of individual playing pieces, a plurality of pairs of playing pieces and a plurality of minor playing pieces; each of said individual playing pieces, each of said pairs of playing pieces and said minor playing pieces are movable to different subsets of said plurality of playing pieces.

2. The apparatus according to claim 1, further comprising:

a center means for identifying the center of each of said first and second playing surfaces.

3. The apparatus according to claim 2, wherein said center means is located at the median of said coincident side shared by contiguous ones of said plurality of playing spaces on said first playing surface.

4. The apparatus according to claim 2, wherein said center means is located at a common intersection of said angles of six of said plurality of playing spaces on said second playing surface.

5. The apparatus according to claim 1, wherein said plurality of playing spaces are congruent with respect to one another.

6. The apparatus according to claim 1, further comprising a plurality of neutral spaces, each of said plurality of neutral spaces is a right triangle occupying one half the area of one of said plurality of playing spaces.

7. The apparatus according to claim 1, wherein the number of minor playing pieces is equal to the sum of the individual and pairs playing pieces.

8. The apparatus according to claim 1, wherein each of said first and second playing surfaces has 54 playing spaces; and each of said first and second sets of playing pieces include three individual playing pieces, three pairs of playing pieces as well as nine minor playing pieces.

9. The apparatus according to claim 1, wherein said plurality of playing spaces are evenly divided between first and second types of playing spaces.

10. The apparatus according to claim 9, wherein each of said sides of said first type of playing space are coincident with one side of each of three of said second type of playing space.

11. The apparatus according to claim 1, wherein said playing pieces and each of said first and second playing surfaces are magnetically attracted with respect to one another.

12. The apparatus according to claim 1, wherein said playing pieces have a generally flat and circular configuration.

13. The apparatus according to claim 1, wherein said playing pieces are generally three dimensional.

14. The apparatus according to claim 1, wherein the ratio of playing spaces to playing pieces is 1.5:1.

15. The apparatus according to claim 1, further comprising label means for identifying each said plurality of playing spaces.

16. The apparatus according to claim 1, wherein said label means are located outside said perimeter and define a rectangular grid, each of said plurality of playing spaces is identified with one coordinate from along each axis of said rectangular grid.

* * * * *

UNITED STATES PATENT AND TRADEMARK OFFICE

CERTIFICATE OF CORRECTION

PATENT NO. : 5,286,030

DATED : February 15, 1994

INVENTOR(S) : Butler A. Villagomez

It is certified that error appears in the above-indentified patent and that said Letters Patent is hereby corrected as shown below:

Column 8, line 20, delete "piece".
Column 8, line 22, after "game" insert --piece.--.
Column 8, line 61, change "oval" to --ova--.
Column 10,line 55, change "of" to --on --.
Column 11, line 20, change "pieces" to --spaces --.

Signed and Sealed this

Second Day of August, 1994

*Attest:*

Bruce Lehman

BRUCE LEHMAN

*Attesting Officer*

*Commissioner of Patents and Trademarks*